US005512878A

United States Patent [19]

Balch et al.

[11] Patent Number: 5,512,878

[45] Date of Patent: Apr. 30, 1996

[54] PULSED ELECTRONIC ARTICLE SURVEILLANCE SYSTEMS

[75] Inventors: Brent Balch, Fort Lauderdale, Fla.; David L. Roberson, Forest, Va.

[73] Assignee: Sensormatic Electronics Corporation, Deerfield, Fla.

[21] Appl. No.: 319,263

[22] Filed: Oct. 6, 1994

[51] Int. Cl.[6] ..... G08B 13/14

[52] U.S. Cl. ..... 340/572; 340/551

[58] Field of Search ..... 340/572, 551, 340/825.54; 455/127

[56] References Cited

U.S. PATENT DOCUMENTS

| | | | |
|---|---|---|---|
| 5,103,209 | 4/1992 | Lizzi | 340/572 |
| 5,103,222 | 4/1992 | Hogen Esch et al. | 340/572 |
| 5,121,103 | 6/1992 | Minasy | 340/572 |
| 5,239,696 | 8/1993 | Balch | 455/127 |
| 5,266,926 | 11/1993 | Beigel | 340/572 |
| 5,300,922 | 4/1994 | Stoffer | 340/572 |
| 5,304,983 | 4/1994 | Zhou | 340/572 |
| 5,345,222 | 9/1994 | Davies | 340/572 |
| 5,353,011 | 10/1994 | Wheeler | 340/572 |
| 5,373,301 | 12/1994 | Bowers | 340/572 |

*Primary Examiner*—John K. Peng
*Assistant Examiner*—Albert K. Wong
*Attorney, Agent, or Firm*—Robin, Blecker, Daley & Driscoll

[57] ABSTRACT

An electronic article surveillance (EAS) system includes a transmitting antenna, a driver operable for exciting the transmitting antenna, a receiving antenna and circuitry connected to the receiving antenna for improving the quality of transmissions from the transmitting antenna. The driver excites the transmitting antenna at a preselected system operating frequency and the circuitry connected to the receiving antenna improves the quality of transmissions from the transmitting antenna by lessening harmonics of the operating frequency in the transmissions. The harmonics are attributable to protection diodes connected to the receiving antenna for limiting voltages impressed thereon and otherwise adversely impacting on the receiver tag signal processing circuitry. The harmonic lessening circuitry is connected in parallel with the protection diodes and is operative to lessen protection diode harmonic generation.

26 Claims, 3 Drawing Sheets

PULSED ELECTRONIC ARTICLE SURVEILLANCE SYSTEMS

FIELD OF THE INVENTION

This invention relates generally to electronic article surveillance (EAS) and pertains more particularly to improved EAS systems.

BACKGROUND OF THE INVENTION

One present commercially implemented EAS system has a transmitter which radiates a pulsed magnetic field into a surveillance area wherein it is desired to note the presence of articles bearing EAS tags. When a tagged article is present in the surveillance area, its tag is excited by the radiated magnetic field and, based on its composition, is caused to generate a detectable response signal. A receiver, which is enabled between successively spaced transmitter field radiations, detects the response signal of the tag and initiates an alarm or other activity to indicate the presence of the tag in the surveillance area.

A transmitter suited for use in the described EAS system is shown in commonly-assigned U.S. Pat. No. 5,239,696 (the '696 patent), to which incorporating reference is hereby made.

Many EAS systems use so-called "transceiver" antennas, wherein the transmitter and receiver coils are in very close proximity. In pulsed EAS systems employing transceiver antennas, current flowing in the transmitting antenna coil induces a secondary current in the closely coupled receiver antenna coil. For practical reasons, the receiver antenna coils typically has many more turns than the transmitter coil, so there is a step-up transformer at hand. To produce peak transmitter currents of ten amps requires several hundred volts to be developed across the transmitter coil. The transformer relationship between antennas means potentials of two thousand volts or more could be induced across the receiver antenna coils. This could lead to voltage breakdown between the windings of the receiver coil, as well as damage to the sensitive receiver circuit input.

A common technique for protecting both the receiver coil itself and the receiver circuitry is to connect two semiconductor diodes in an anti-parallel arrangement across the receiver coil, i.e., the diodes are oppositely polarized. During active transmission times, whenever the voltage induced in the receiver coil exceeds the forward conduction voltage of one of the diodes, the diode conducts, limiting the maximum terminal voltage across the receiver to approximately two volts peak-to-peak.

Since the terminal voltage across the receiver coil is limited, a heavy induced current circulates in the receiver coil and through the diode junctions. The current flowing in the receiver coil generates a radiated magnetic field that contains harmonic distortion caused by the nonlinear conduction characteristic of the protection diodes.

Given the transformer relation between the transmitting coil and the receiving coil, the transmitting coil is of course subject to the receiver coil radiated magnetic field. The transmitter radiated field thus undesirably contains such diode-caused harmonic distortion and system transmissions are of lesser quality than is desired.

SUMMARY OF THE INVENTION

The present invention has as its primary object the improvement of existing EAS systems.

A quite general object of the invention is to improve the quality of transmissions in EAS systems.

A more particular object of the invention is to overcome the above-noted disadvantage in transmitter radiated fields based on need for receiver protection.

In attaining these and other objects, the invention provides, in broad aspect, an EAS system including a transmitting antenna, drive means operable for exciting the transmitting antenna, a receiving antenna and means connected to the receiving antenna for improving the quality of transmissions. It is submitted as unique in EAS systems to look to the receiver for improving transmission quality. Thus, the art has heretofore addressed the receiver and its antenna only in respect of processing tag signals.

The drive means excites the transmitting antenna at a preselected system operating frequency and the means connected to the receiving antenna improves the quality of transmissions by lessening harmonics of the operating frequency in the transmissions.

In another aspect, the invention provides in combination, in an EAS system having successive transmitting and receiving periods and having a preselected operating frequency: a receiving antenna having output terminals; and suppressing means connected to the receiver terminals and operable during the transmitting periods for suppressing the presence therein of signals which are harmonics of the preselected operating frequency.

The invention provides, in a more particular combination, a transmitting antenna, drive means operable for exciting the transmitting antenna at a preselected frequency, a receiving antenna in electromagnetically coupled relation with the transmitting antenna and having output terminals, suppressing means connected to the receiver terminals and operable for suppressing the presence of signals therein which are harmonics of the preselected frequency and control means for concurrently rendering the drive means and the suppressing means operable.

In a particularly preferred EAS system embodiment, the invention provides a transmitting antenna, drive means operable for exciting the transmitting antenna at a preselected frequency, a receiving antenna in electromagnetically coupled relation with the transmitting antenna and having output terminals, means connected to the output terminals for limiting voltage thereacross, and suppressing means connected to the receiver terminals and operable for suppressing the presence of signals therein which are harmonics of the preselected frequency.

The system further includes control means for concurrently rendering the drive means and the suppressing means operable.

The suppressing means comprises circuitry having a linear conduction characteristic and may be constituted by an electronic switching circuit. In a particularly preferred version for use with a balanced receiver antenna, the electronic switch comprises first and second pairs of field effect transistors connected in parallel across the receiver coil output terminals.

In a further version for use with a grounded receiver antenna, the electronic switch comprises first and second field effect transistors connected in parallel across the receiver coil output terminals.

The foregoing and other objects and features of the invention will be further understood from the following detailed description of preferred embodiments thereof and from the drawings, wherein like reference numerals identify like components throughout.

DETAILED DESCRIPTION OF PREFERRED EMBODIMENTS AND PRACTICES

Figure 1:
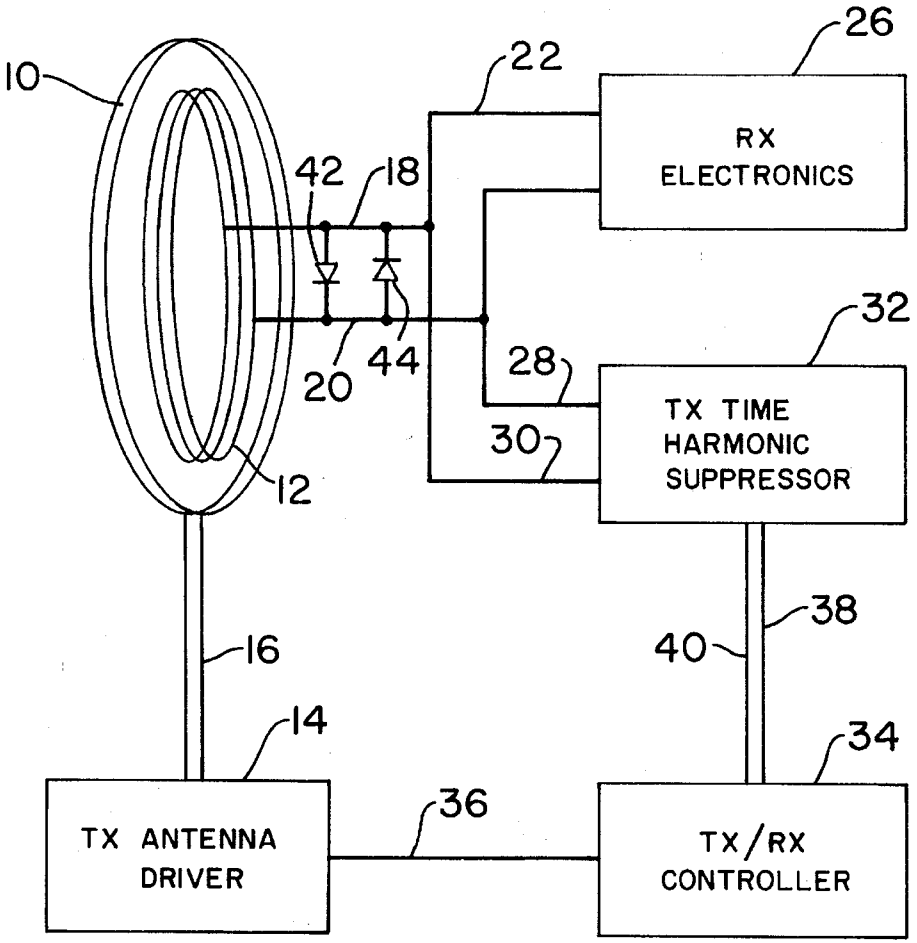
FIG. 1 is a block diagram of an EAS system in accordance with the invention.

Referring to FIG. 1, the EAS system arrangement therein includes a transceiver antenna having an outer coil 10, constituting the transmitting antenna, and an inner coil 12, constituting the receiving antenna. The transmitting antenna is energized by TX ANTENNA DRIVER 14 over lines 16. The receiving antenna output terminals are connected to lines 18 and 20 and output signals are conducted over lines 22 and 24 to RX ELECTRONICS 26 for processing thereof to detect tags.

In accordance with the invention, lines 18 and 20 are further connected by lines 28 and 30 to TX TIME HARMONIC SUPPRESSOR 32, the purpose and functioning of which is discussed below.

TX/RX CONTROLLER 34 defines transmission and receiving times by selectively activating antenna driver 14 by signals on line 36. Controller 34 also controls operating times of harmonic suppressor 32 signals generated on lines 38 and 40.

Voltage limiting diodes 42 and 44 are connected in oppositely polarized manner across lines 18 and 20 as in the prior art system for the aforementioned receiver protection.

Driver 14 may be implemented by circuitry shown in the incorporated '696 patent. Controller 34 may be implemented by the circuitry controlling switch 16 of FIG. 1 of the '696 patent and otherwise by additional circuit means for generating respective positive and negative voltages on lines 38 and 40 during the period of closure of switch 16 of the '696 patent.

Figure 2:
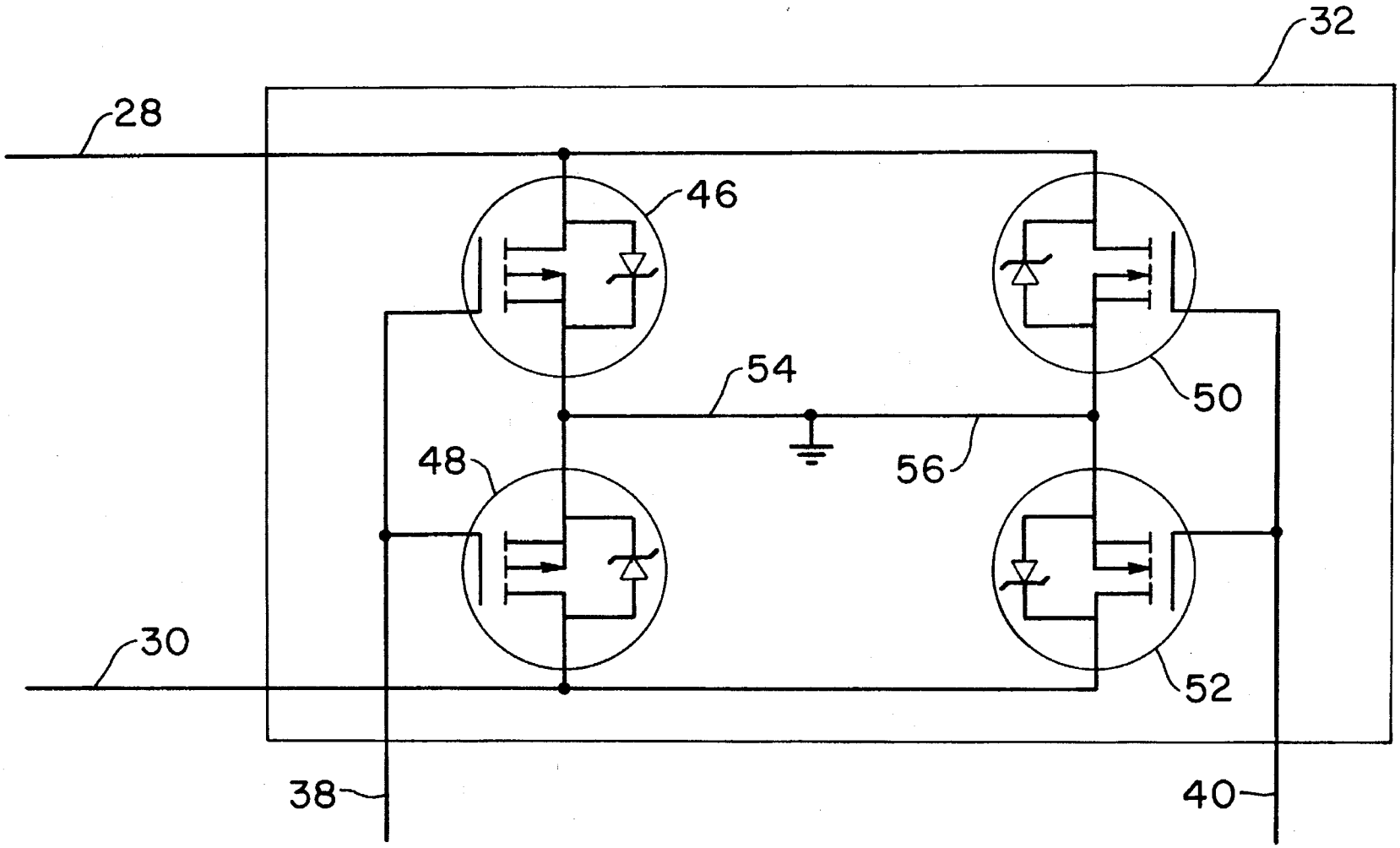
FIG. 2 is an electrical schematic diagram of a preferred version of harmonic suppressor 32 of the FIG. 1 system.

Turning to FIG. 2 and its illustrated preferred embodiment of harmonic suppressor 32 of FIG. 1, signal input lines 28 and 30 have first polarity MOSFETs 46 and 48 connected in a first series circuit thereacross. The gates of MOSFETs 46 and 48 receive the negative voltage on line 38. A second series circuit having second polarity, opposite to the first polarity, MOSFETs 50 and 52, is arranged in parallel with the first series circuit. The gates of MOSFETs 50 and 52 receive the positive voltage on line 40. The junction of MOSFETs 46 and 48 is connected to ground by line 54 and the junction of MOSFETs 50 and 52 is connected to ground by line 56. Thus, harmonic suppressor 32 is a balanced electric circuit, counterpart to the balanced receiver antenna of FIG. 1. The receiving antenna output is applied across the first and second series circuits by lines 28 and 30. The voltages on lines 38 and 40 are present only during system transmitting periods, and the lines have no voltages applied thereto during receiving periods.

While MOSFETs are depicted in FIG. 2, the invention contemplates the use of any electronic switch having resistance characteristics discussed hereinafter.

Applicants implement FIG. 2 preferably with MOSFET type IRFD110/N and type 1RFD9120/P, commercially available from International Rectifier.

A characteristic of a MOSFET significant to the subject invention is RDS(on), i.e., static drain-to-source "on" resistance, which, for the above-identified MOSFETs, is a maximum of 0.6 ohm. With two thereof in series, the maximum resistance is 1.2 ohms. A typical diode used for receiver voltage limiting is a 1N4003, which, with one ampere (peak) flowing through it, exhibits a resistance of about 0.96 ohm. In order to reduce diode current to ten milliamps peak, the junction voltage must be held below 0.6 volt peak.

Applicants expected that gaining their desired result would involve selecting components such that twice RDS(on) (arising from the series connection) be less than the resistance of the protection diode. In this respect, only one branch of the MOSFETs is conductive at any one time, given the oppositely-polarized configuration and the need to address positive and negative going cycles of the transmitting antenna excitation. This would call for the MOSFETs each to exhibit an RDS(on) of about 0.48 ohm or less.

However, since the MOSFETs are in parallel with the protection diodes, as they conduct current, they steal current away from the diodes. With less current flowing in the protection diodes, their junction resistance increases and more current flows through the MOSFETs. Experimentation has shown that reducing the protection diode junction voltage, which occurs on lessening of the protection diode current, to about 0.6 volt can reduce the current flowing through the protection diode junction by up to forty decibels (40 db).

According to the subject invention, the protection diodes remain in place for their desired voltage limiting role in receiver and receiver coil protection. However, the effects of their nonlinear conduction characteristics can be greatly reduced if not eliminated by applicants' adjunct thereto, i.e., a current demanding electronic switch with substantially linear conduction characteristics.

Figure 3:
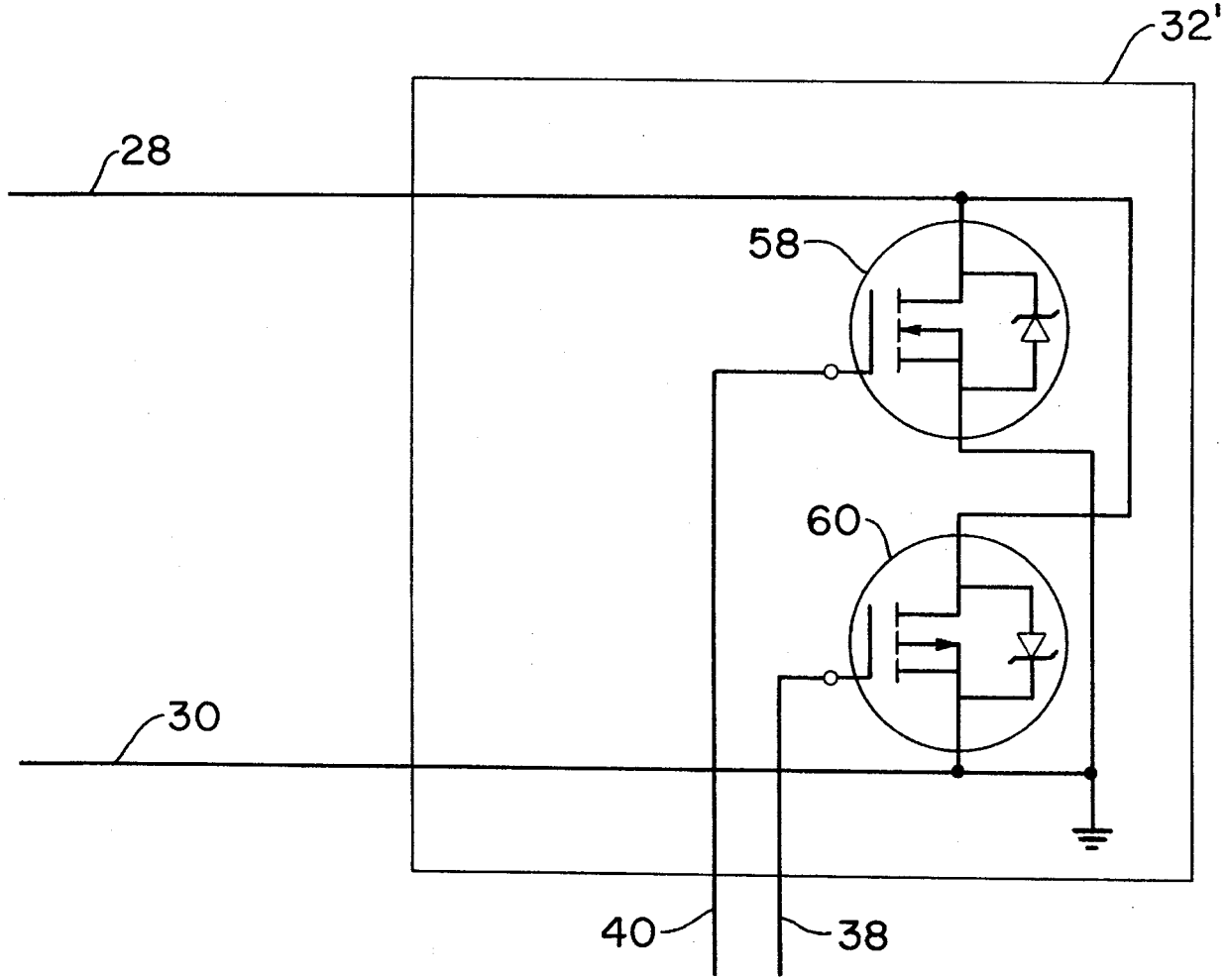
FIG. 3 is an electrical schematic diagram of a further version of a harmonic suppressor.

Referring to FIG. 3, harmonic suppressor 32' is for use with a grounded a version of a receiving antenna connected across lines 28 and 30. Here, MOSFET 58 has its gate connected to line 40 and is connected across lines 28 and 30. MOSFET 60 is of polarity opposite that of MOSFET 58, has its gate connected to line 38 and is likewise connected across lines 28 and 30, i.e., in parallel with MOSFET 58.

Various changes in structure to the described systems and apparatus and modifications in the described practices may evidently be introduced without departing from the invention. Thus, while the invention has been disclosed in the context of a "transceiver", with the transmitting and receiving antennas concentrically related, the invention is applicable to any composite antenna pair wherein transmitting and receiving coils are so electromagnetically coupled to one as to obtain benefit from the invention and its harmonic suppressor. Accordingly, it is to be understood that the particularly disclosed and depicted embodiments are intended in an illustrative and not in a limiting sense. The true spirit and scope of the invention are set forth in the following claims.

What is claimed is:

1. In combination, in an electronic article surveillance system:

a) a transmitting antenna;

b) drive means controllable for exciting said transmitting antenna at a preselected frequency;

c) a receiving antenna separate from and in electromagnetically coupled relation with the transmitting antenna and having output terminals;

d) suppressing means separate from said transmitting antenna and connected to said receiving antenna output terminals and controllable for suppressing the presence of signals in the receiving antenna which are harmonics of said preselected frequency; and e) control means for concurrently controlling said drive means and said suppressing means.

2. The invention claimed in claim 1 wherein said control means defines respective transmitting and receiving periods for said system and controls said drive means and said suppressing means exclusively during said transmitting periods.

3. The invention claimed in claim 1 wherein said transmitting antenna comprises a first coiled conductor and said receiving antenna comprises a second coiled conductor.

4. The invention claimed in claim 1 wherein said suppressing means comprises circuitry having a substantially linear conduction characteristic.

5. In combination, in an electronic article surveillance system having successive transmitting and receiving periods and having a preselected operating frequency:

a) a transmitting antenna and a receiving antenna Separate from said transmitting antenna and having receiving antenna output terminals; and b) suppressing means separate from said transmitting antenna and connected to said receiving antenna output terminals for suppressing the presence in said receiving antenna of signals which are harmonics of said preselected operating frequency during said transmitting periods.

6. The invention claimed in claim 5 wherein said suppressing means comprises circuitry having a substantially linear conduction characteristic.

7. The invention claimed in claim 6 wherein said suppressing means is controllable for suppressing the presence in said receiving antenna of signals which are harmonics of said preselected operating frequency, further including control means for controlling said suppressing means during said transmission periods and not controlling said suppressing means during said receiving periods.

8. In combination, in an electronic article surveillance system having successive transmitting and receiving periods and having a preselected operating frequency:

a) a transmitting antenna and a receiving antenna separate from said transmitting antenna and having receiving antenna output terminals;

b) means connected to said receiving antenna output terminals for limiting voltage thereacross; and c) suppressing means separate from said transmitting antenna and connected to said receiving antenna output terminals and for suppressing the presence in said receiving antenna of signals which would be generated in the receiving antenna by the voltage limiting means.

9. The invention claimed in claim 8 wherein said suppressing means comprises circuitry having a substantially linear conduction characteristic.

10. The invention claimed in claim 9 wherein said suppressing means is controllable for suppressing the presence in said receiving antenna of signals which are harmonics of said preselected operating frequency, further including control means for controlling said suppressing means during said transmission periods and not controlling said suppressing means during said receiving periods.

11. The invention claimed in claim 8, wherein said voltage limiting means comprises first and second diodes connected across said output terminals and mutually oppositely polarized.

wherein said

12. The invention claimed in claim 11, suppressing means comprises an electronic switch.

13. The invention claimed in claim 12, wherein said electronic switch comprises at least one field effect transistor.

14. The invention claimed in claim 12, wherein said electronic switch comprises first and second series circuits connected across said output terminals, said first series circuit having a pair of first polarity field effect transistors series-connected therein, said second series circuit having a pair of second polarity field effect transistors series-connected therein, said second polarity being opposite to said first polarity.

15. The invention claimed in claim 12, wherein said electronic switch comprises first and second field effect transistors connected across said output terminals and mutually oppositely polarized.

16. An electronic article surveillance system, comprising:

a) a transmitting antenna;

b) drive means for exciting said transmitting antenna at a preselected frequency;

c) a receiving antenna separate from and in electromagnetically coupled relation with the transmitting antenna and having receiving antenna output terminals;

d) means connected to said receiving antenna output terminals for limiting voltage thereacross; and e) suppressing means separate from said transmitting antenna and connected to said receiving antenna output terminals for suppressing the presence of signals in said receiving antenna which are harmonics of said preselected frequency.

17. The system claimed in claim 16 wherein said suppressing means is controllable for suppressing the presence in said receiving antenna of signals which are harmonics of said preselected operating frequency and wherein said drive means is controllable for exciting said transmitting antenna at said preselected frequency, further including control means for concurrently controlling said drive means and said suppressing means.

18. The invention claimed in claim 17 wherein said control means defines respective transmitting and receiving periods for said system and controls said drive means and said suppressing means exclusively during said transmitting periods.

19. The invention claimed in claim 16 wherein said transmitting antenna comprises a first coiled conductor and said receiving antenna comprises a second coiled conductor.

20. The invention claimed in claim 16 wherein said suppressing means comprises circuitry having a linear conduction characteristic.

21. The invention claimed in claim 16, wherein said voltage limiting means comprises first and second diodes connected across said receiving antenna output terminals and mutually oppositely polarized.

22. The invention claimed in claim 21, wherein said suppressing means comprises an electronic switch.

23. The invention claimed in claim 22, wherein said electronic switch comprises first and second series circuits connected across said receiving antenna output terminals, said first series circuit having a pair of first polarity field effect transistors series-connected therein, said second series circuit having a pair of second polarity field effect transistors series-connected therein, said second polarity being opposite to said first polarity.

24. The invention claimed in claim 22, wherein said electronic switch comprises first and second field effect transistors connected across said receiving antenna output terminals and mutually oppositely polarized.

25. An electronic article surveillance system, comprising:

a) a transmitting antenna;

b) drive means for exciting said transmitting antenna;

c) a receiving antenna separate from said transmitting antenna and electromagnetically coupled therewith; and d) means separate from said transmitting antenna and connected to said receiving antenna for improving the quality of transmissions from said system.

26. The system claimed in claim 25, wherein said drive means excites said transmitting antenna at a preselected system operating frequency and wherein said means separate from said transmitting antenna and connected to said receiving antenna improves the quality of transmissions from said system by lessening harmonics of said operating frequency in said system transmissions.

* * * * *

UNITED STATES PATENT AND TRADEMARK OFFICE

CERTIFICATE OF CORRECTION

PATENT NO. : 5,512,878

DATED : April 30, 1996

INVENTOR(S) : Brent Balch, et al.

It is certified that error appears in the above-indentified patent and that said Letters Patent is hereby corrected as shown below:

Col. 5, line 19, change "Separate" to -- separate --.

Col. 5, line 65, delete "wherein said".

Col. 5, line 66, after "claim 11," insert -- wherein said --.

Signed and Sealed this

Fifteenth Day of October, 1996

Bruce Lehman

*Attest:*

BRUCE LEHMAN

*Attesting Officer*

*Commissioner of Patents and Trademarks*